US009536488B2

(12) United States Patent
Woo et al.

(10) Patent No.: US 9,536,488 B2
(45) Date of Patent: Jan. 3, 2017

(54) GAMMA VOLTAGE SUPPLY CIRCUIT AND METHOD AND POWER MANAGEMENT IC

(71) Applicant: SILICON WORKS CO., LTD., Daejeon-si (KR)

(72) Inventors: Young Jin Woo, Daejeon-si (KR); Young Sik Kim, Daejeon-si (KR); Ji Hun Kim, Daejeon-si (KR); Byeong Jae Park, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 98 days.

(21) Appl. No.: 14/085,437

(22) Filed: Nov. 20, 2013

(65) Prior Publication Data

US 2015/0138056 A1 May 21, 2015

(51) Int. Cl.
*G09G 5/00* (2006.01)
*G09G 3/36* (2006.01)

(52) U.S. Cl.
CPC .... *G09G 3/3696* (2013.01); *G09G 2320/0276* (2013.01); *G09G 2320/0673* (2013.01)

(58) Field of Classification Search
CPC ..... G06F 1/26; G05F 1/10
USPC ..... 345/211–213; 315/169.1–169.4
See application file for complete search history.

(56) References Cited

U.S. PATENT DOCUMENTS

| | | | | |
|---|---|---|---|---|
| 4,570,115 | A * | 2/1986 | Misawa | G05F 3/20 323/313 |
| 6,400,349 | B1 * | 6/2002 | Nagumo | 345/82 |
| 2003/0201959 | A1 * | 10/2003 | Sakaguchi | 345/87 |
| 2007/0146287 | A1 * | 6/2007 | Lee | 345/100 |
| 2013/0271507 | A1 * | 10/2013 | Kim et al. | 345/690 |

* cited by examiner

*Primary Examiner* — Ram Mistry
(74) *Attorney, Agent, or Firm* — Kile Park Reed & Houtteman PLLC

(57) ABSTRACT

The present invention provides a gamma voltage supply circuit capable of stably supplying a gamma voltage in response to the change of external voltage and a power management IC including the same. The gamma voltage supply circuit generates a regulating voltage using an internal voltage which is not influenced by the variation in load of a source driver IC, and generates a gamma voltage using the regulating voltage.

13 Claims, 3 Drawing Sheets

GAMMA VOLTAGE SUPPLY CIRCUIT AND METHOD AND POWER MANAGEMENT IC

BACKGROUND OF THE INVENTION

Field of the Invention

The present invention relates to a power management integrated circuit (IC), and more particularly, to a gamma voltage supply circuit and method which is capable of stably supplying a gamma voltage in response to the change of external voltage, and a power management IC having the same.

Description of the Related Art

A display system includes a flat panel employing a display panel such as a liquid crystal display and a power management IC to supply power to internal parts thereof.

The power management IC may be implemented in the form of a chip, and configured to generate voltages required for operations of a source driver IC, a gate driver IC, a timing controller, and the display panel. In particular, the power management IC includes a gamma voltage supply circuit therein, and supplies a gamma voltage generated by the gamma voltage supply circuit to the source driver IC. The gamma voltage is used in the source driver IC so as to express an image using data.

Furthermore, the power management IC is configured to generate a variety of voltages, such as a source driving voltage for the source driver IC, gate high and low voltages for the gate driver IC, and a common voltage required for driving the liquid crystal display, as well as the gamma voltage. Furthermore, the power management IC commonly uses an external voltage to generate the above-described voltages. That is, the gamma voltage supply circuit commonly uses an external voltage to generate the gamma voltage.

In a power environment where the above-described external voltage is commonly used, a load may be suddenly changed. In this case, the gamma voltage may be destabilized by the influence of the sudden change of load.

For example, the source driver IC performs an operation of temporarily consuming a large amount of current so as to drive a large number of pixels corresponding to one line at the same time. That is, a sudden change of load may occur in the source driver IC. Thus, the level of the external voltage may be rapidly changed in response to the sudden change of load.

When the level of the external voltage applied to the power management IC is rapidly changed by the above-described load change, the gamma voltage supply circuit is influenced by the change in level of the external voltage. That is, the gamma voltage generated through the external voltage may significantly drop. Thus, when the gamma voltage is destabilized, an image quality may be degraded.

In order to prevent the gamma voltage from being destabilized, the gamma voltage supply circuit of the power management IC may have a filter mounted therein, the filter including a resistor and a capacitor. However, the filter may relieve the instability of the gamma voltage, but has difficulties in completely overcoming the instability. Furthermore, in order to sufficiently overcome the instability of the gamma voltage, a capacitor having a large capacity may be required. In this case, however, the size of the power management IC, that is, the chip size may be inevitably increased.

SUMMARY OF THE INVENTION

Accordingly, the present invention has been made in an effort to solve the problems occurring in the related art, and an object of the present invention is to provide a power management IC which is capable of supplying a gamma voltage at a stable level to a source driver IC.

Another object of the present invention is to provide a gamma voltage supply circuit and a power management IC, which is capable of reducing a chip size while stably supplying a gamma voltage to a source driver IC.

In order to achieve the above object, according to one aspect of the present invention, a gamma voltage supply circuit includes: an internal voltage generator configured to generate a boosted internal voltage through an external voltage; and a digital-to-analog converter configured to generate gamma voltages corresponding to a plurality of channels using a regulating voltage obtained by regulating the internal voltage and supply the gamma voltages to one or more selected channels.

According to another aspect of the present invention, there is provided a power management IC which supplies gamma voltages outputted from a plurality of channels to a source driver IC. The power management IC includes: a regulator configured to supply a regulating voltage by regulating an internal voltage obtained by boosting an external voltage; a resistor string configured to generate the gamma voltages corresponding to the plurality of channels using the regulating voltage; a switch circuit including a plurality of switches to transfer the gamma voltages to the plurality of channels, and configured to supply the gamma voltages to one or more selected channels according to the programming states of the switches; and gamma buffers configured to output the one or more gamma voltages supplied from the switch circuit through the channels.

According to another aspect of the present invention, a gamma voltage supply method includes: generating, by a regulator, a regulating voltage using an internal voltage obtained by boosting an external voltage; generating, by a digital-to-analog converter, gamma voltages by dividing the regulating voltage; switching, by the digital-to-analog converter, outputs of the gamma voltages for output channels, respectively; and buffering, by a gamma buffer, the gamma voltages outputted through the switching and outputting the buffered voltages for the respective channels.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
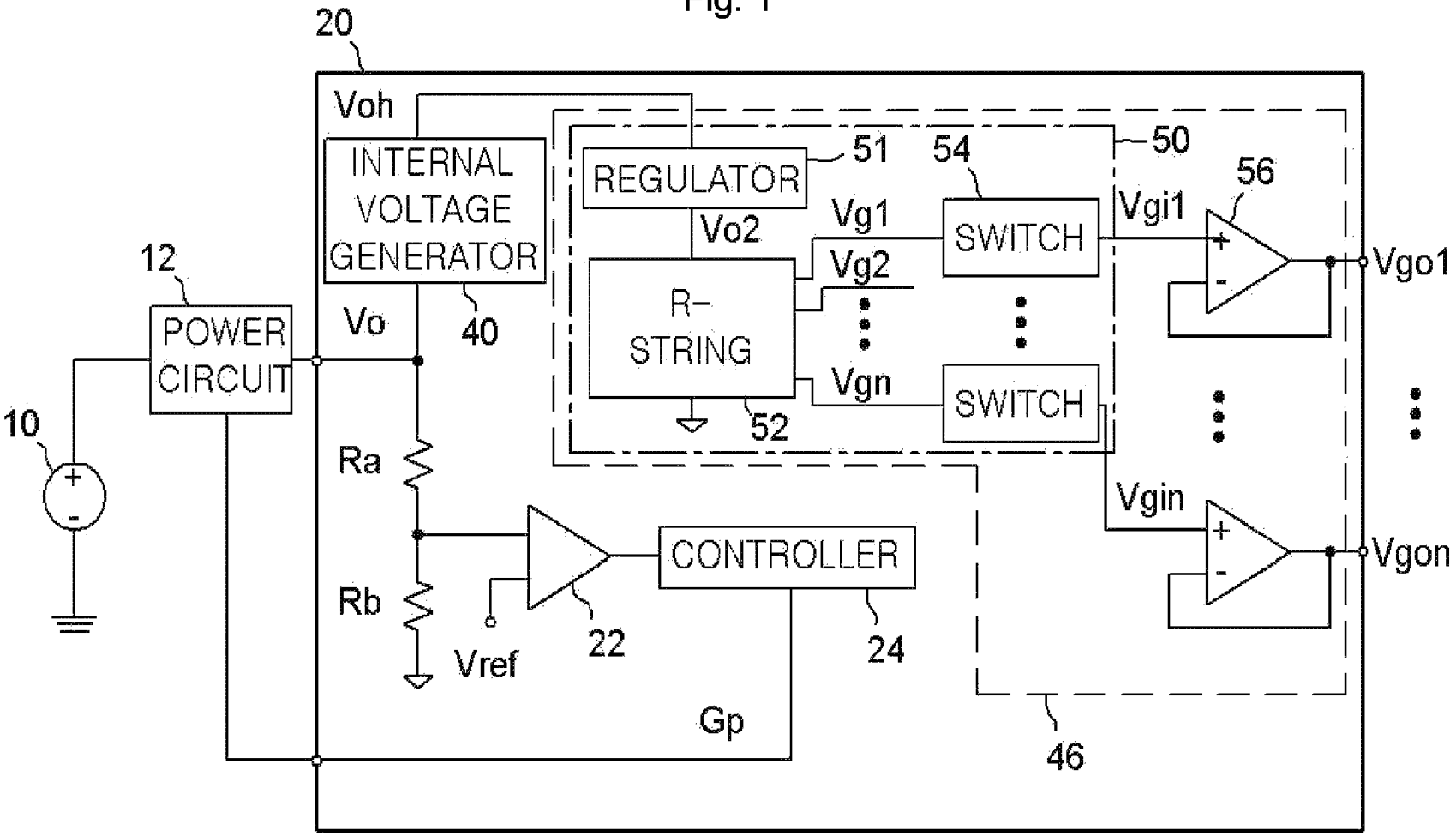
FIG. 1 is a circuit diagram illustrating a power management IC according to an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 illustrates an example of a circuit to supply power to a display system. The circuit includes a power circuit 12 to supply an external voltage Vo using a supply voltage 10 and a power management IC 20 to output a gamma voltage using the external voltage Vo.

The power circuit 12 is connected to the AC voltage 10 and configured to output a DC voltage. The voltage outputted from the power circuit 12 may be defined as the external voltage Vo from the point of view of the power management IC 20. Furthermore, the power circuit 12 may include typical components for converting the AC voltage to the DC voltage, that is, an inductor, a capacitor, a switch and the like. The power circuit 12 may uniformly maintain the level of the external voltage Vo through a gate pulse Gp supplied from the power management IC 20.

The power management IC 20 according to the embodiment of the present invention may generate a variety of voltages required for operations a source driver IC (not illustrated), a gate driver IC (not illustrated), a timing controller (not illustrated), and a display panel (not illustrated), which are included in the display system.

The power management IC according to the embodiment of the present invention may be configured to supply a gamma voltage, of which the level is maintained at a stable level even though the level of the external voltage Vo is varied, to the source driver IC. Thus, the power management IC 20 of FIG. 1 may include a variety of parts to generate the gamma voltage.

The power management IC 20 may be implemented with one chip, and may include resistors Ra and Rb to sense the external voltage Vo, a comparator 22, and a controller 24.

The variation of the external voltage Vo in the power management IC 20 may be sensed through the resistors Ra and Rb, and a voltage obtained by dividing the external voltage Vo through the resistors Ra and Rb is provided to the comparator 22. The comparator 22 compares the variation of the external voltage Vo to a reference voltage Vref using the input voltage. The controller 24 outputs a gate pulse Gp corresponding to an output of the comparator 22. That is, through the gate pulse Gp corresponding to a rise or drop of the external voltage Vo, the power circuit 12 may control an internal current to maintain the level of the external voltage Vo.

The power management IC 20 according to the embodiment of the present invention includes an internal voltage generator 40 and a gamma voltage supply circuit 46.

The internal voltage generator 40 is configured to receive the external voltage Vo, and generate a voltage for an internal operation or a voltage to supply to the source driver IC, the gate driver IC and the like. Among the voltages generated by the internal voltage generator 40, the voltage for internal operation may include the reference voltage Vref, the voltage for the source driver IC may include a source driving voltage, the voltage for the gate driver IC may include a gate high voltage Voh or gate low voltage, and the voltage for the display panel may include a common voltage.

The internal voltage generator 40 may supply an internal voltage obtained by boosting the external voltage Vo. An example of the internal voltage may include the gate high voltage Voh which is one of the gate voltages provided to the gate driver IC. The internal voltage generator 40 may typically receive an external voltage Vo of about 5V, and may be designed to provide a voltage, obtained by boosting the external voltage Vo to 18V, as the gate high voltage Voh. Hereafter, the internal voltage may be selected from voltages which have a higher level than the external voltage Vo and of which the levels are not significantly changed because they are less influenced by the change of load. In the present embodiment, the gate high voltage Voh may be used.

The gamma voltage supply circuit 46 generates gamma voltages Vgo1-Vgon. In the present embodiment, the gamma voltages Vgo1-Vgon may be divided into first gamma voltages Vg1-Vgn, second gamma voltages Vgi1-Vgin, and third gamma voltages Vg01-Vgon. The first to third gamma voltages may be referred to as gamma voltages.

In order to generate the above-described gamma voltages Vgo1-Vgon, the gamma voltage supply circuit 46 includes a digital-to-analog converter 50 and gamma buffers 56 provided for a plurality of channels to output the respective gamma voltages Vgo1-Vgon.

Furthermore, the digital-to-analog converter 50 includes a regulator 51, a resistor string 52, and a switch circuit.

Figure 2:
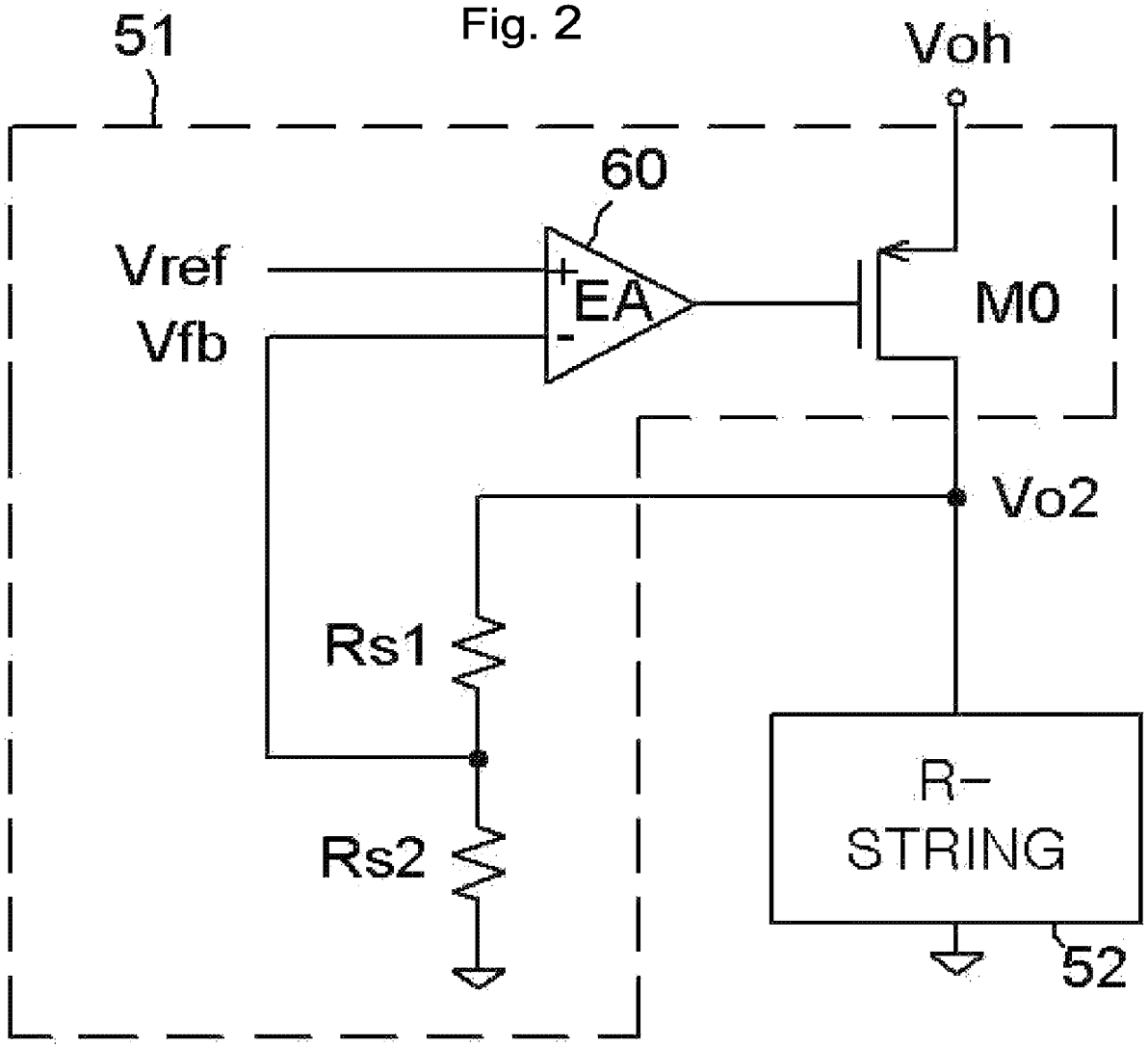
FIG. 2 is a circuit diagram of a regulator illustrated in FIG. 1.
Figure 3:
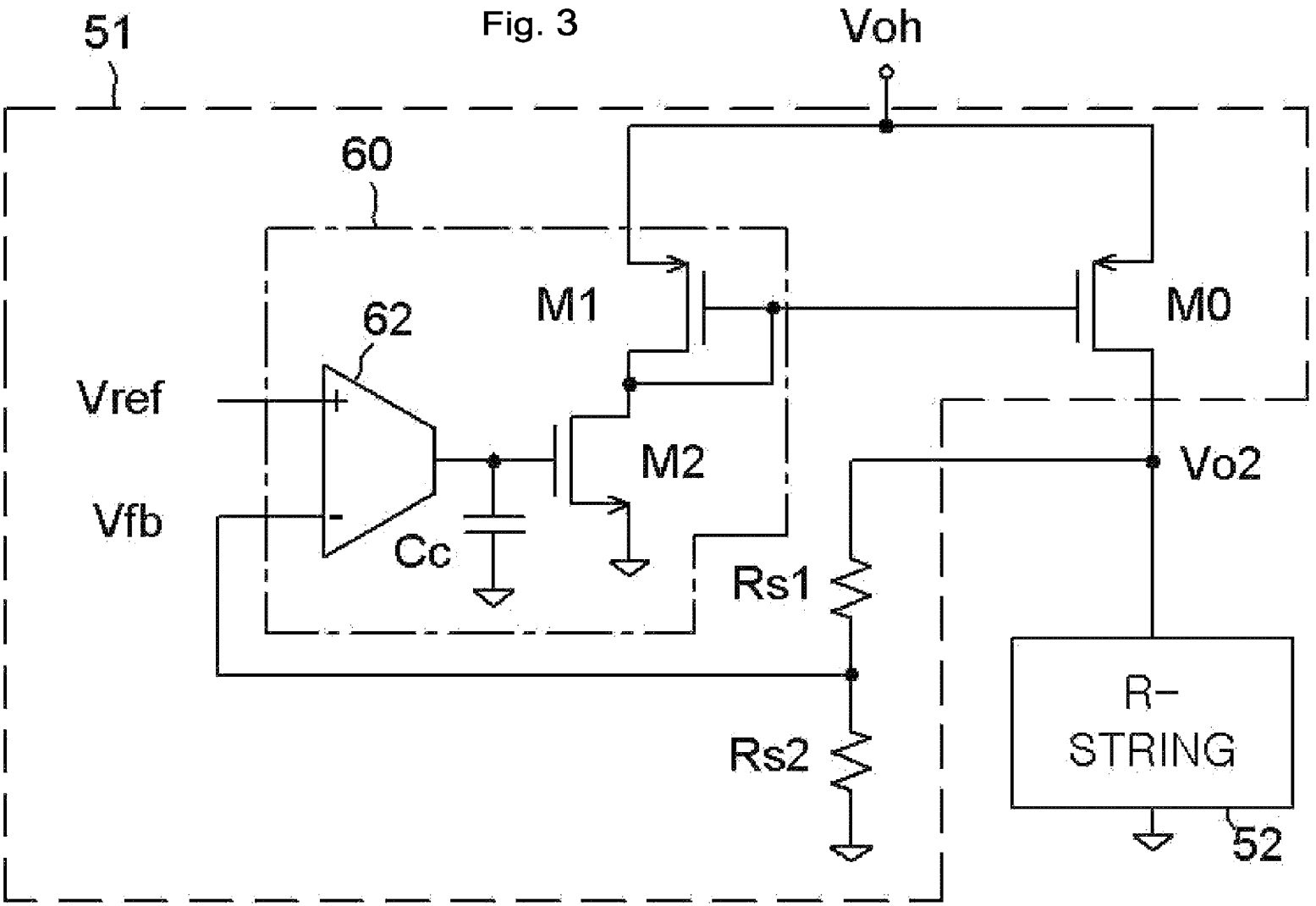
FIG. 3 is a detailed circuit diagram of the regulator illustrated in FIG. 1.

The regulator 51 is configured to generate a regulating voltage Vo2 obtained by regulating the gate high voltage Voh and provide the regulating voltage Vo2 to the resistor string 52. More specifically, the regulator 51 may be configured to regulate the gate high voltage Voh to have the same level as the external voltage Vo. As a result, the regulating voltage Vo2 may be provided to the resistor string 52. The regulator 51 may be configured to provide the regulating voltage Vo2 through current control as illustrated in FIGS. 2 and 3.

The resistor string 52 is configured to generate first gamma voltages Vg1-Vgn corresponding to the plurality of channels using the regulating voltage Vo2. More specifically, the resistor string 52 may include resistors connected in series, and output the first gamma voltages Vg1-Vgn obtained by dividing the external voltage Vo at nodes between the resistors, respectively. That is, the resistor string 52 serves as a constant voltage source to supply the first gamma voltages Vg1-Vgn.

The switch circuit includes a plurality of switches 54 configured to output the second gamma voltages Vgi1-Vgin for a plurality of channels, respectively. The plurality of switches 54 switch the first gamma voltages Vg1-Vgn, respectively, and output the second gamma voltages Vgi1-Vgin as the switching results. Furthermore, the plurality of switches 54 may be programmed to be turned on in response to one or more selected channels.

The gamma buffers 56 are configured to buffer the second gamma buffers Vgi1-Vgin outputted from the turned-on switches 54 and output the third gamma voltages Vg01-Vgon, respectively.

In the above-described configuration, the regulator 51 may include a comparison circuit 60, a current control element M0, and a sensing circuit.

The comparison circuit 60 may be configured to compare the reference voltage Vref to a feedback voltage Vfb and output a current corresponding to the comparison result. The comparison circuit 60 may be implemented with an error amplifier.

The current control element M0 may include a PMOS transistor configured to receive an output of the comparison circuit 60 through a gate thereof. The current control element M0 regulates the gate high voltage Voh applied to a source thereof in response to the output current of the comparison circuit 60, and outputs the regulating voltage Vo2 through a drain thereof. As described above, the resistance of the current control element M0 may be controlled to equalize the regulating voltage Vo2 to the external voltage Vo.

The sensing circuit includes resistors Rs1 and Rs2 connected in series to the output terminal of the current control element M0, and is configured to provide a feedback voltage Vfb, obtained by dividing the regulating voltage Vo2 through the resistors Rs1 and Rs2, to the comparison circuit 60. The serially-connected resistors Rs1 and Rs2 may be connected in parallel to the resistor string 52.

The comparison circuit 60 of FIG. 2 will be described in more detail with reference to FIG. 3, and the duplicated descriptions of the same components as those of FIG. 2 are omitted herein.

The comparison circuit 60 includes a comparator 62, a compensation capacitor Cc, and a current control circuit.

The comparator 62 is configured to compare the feedback voltage Vfb to the reference voltage Vref and output a signal corresponding to the comparison result, and the compensator capacitor Cc is configured to compensate for the output of the comparator 62 so as to stabilize the signal.

The current control circuit may include switching elements M1 and M2 connected in series. The switching element M1 may be implemented with a PMOS transistor, and the switching element M2 may be implemented with an NMOS transistor. The switching element M1 is configured to receive the gate high voltage Voh through a source thereof, and the switching element M2 is configured to receive a ground voltage through a source thereof. The drains of the switching elements M1 and M2 are commonly connected to form a node, and the common drain node formed between the switching elements M1 and M2 is connected to the gate of the switching element M1. Furthermore, the gates of the switching element M1 and the current control element M0 are coupled to each other.

According to the above-described configuration, the gate high voltage Voh is regulated through the operation of the current control element M0, and the current control element M0 outputs the regulating voltage Vo2.

The regulating voltage Vo2 is sensed through the resistors Rs1 and Rs2, and the comparator 62 compares the reference voltage Vref and the feedback voltage Vfb and provides the comparison result to the switching element M2.

When the regulating voltage Vo2 as a low level, the comparator 62 outputs a high-level voltage, and the switching element M2 is turned on. Then, the gate levels of the current control element M0 and the switching element M1 coupled to each other decrease. That is, the amount of current flowing in the switching element ml and the current control element M0 increases. The amount of current may be proportional to channel resistance.

That is, when the regulating voltage Vo2 has a low level, the current amount of the current control element M0 increases. As a result, the regulating voltage Vo2 may maintain a constant level.

On the other hand, when the regulating voltage Vo2 has a high level, the comparator 62 outputs a low-level voltage, and the switching element M2 is turned off. Thus, the gate levels of the current control element M0 and the switching element M1 coupled to each other increase. That is, the amount of current flowing in the switching element M1 and the current control element M0 decreases.

That is, when the regulating voltage Vo2 has a high level, the current amount of the current control element M0 decreases. As a result, the regulating voltage Vo2 may maintain a constant level.

The circuit according to the embodiment of the present invention supplies the regulating voltage Vo2 obtained by regulating the gate high voltage Voh to the resistor string 52.

The gate high voltage Voh is a voltage boosted by the internal voltage generator 20, and is not significantly influenced by the variation of the external voltage Vo. Furthermore, the gate high voltage Voh is sequentially distributed for each line and driven to a high voltage. Thus, the gate high voltage Voh is not significantly influenced by the change of load. That is, the gate high voltage Voh may be supplied while stably maintaining the level thereof.

Thus, as the regulator 51 uses the gate high voltage Voh which stably maintain the level, the regulator 51 may not be significantly influenced by the variation of the external voltage Vo or load, but may output the stable regulating voltage Vo2. Furthermore, since the regulation of the regulator 51 is controlled by the current control through feedback, the regulator 51 may provide the regulating voltage Vo2 more stably.

Furthermore, the digital-to-analog converter 50 including the resistor string 52 and the switches 54 generates a gamma voltage using the regulating voltage Vo2 having the same level as the external voltage Vo. Thus, the circuit according to the embodiment of the present invention may generate a gamma voltage in the same voltage environment as the environment using the external voltage Vo.

Through the above-described configuration, the circuit according to the embodiment of the present invention may stably provide the gamma voltages Vgo1-Vgon using the gate high voltage Voh as an internal voltage. Thus, the image quality may be improved.

Furthermore, the voltage management IC according to the embodiment of the present invention may exclude filter circuits including a capacitor and a resistor, which are configured for the respective output channels of the power management IC so as to stabilize the gamma voltages Vgo1-Vgon. Thus, the chip size of the voltage management IC may be reduced.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A gamma voltage supply circuit comprising:

an internal voltage generator configured to generate an internal voltage which is boosted, by using an external voltage, and supply the internal voltage to a current control element; and a digital-to-analog converter configured to generate a regulating voltage by regulating the internal voltage through the current control element, generate gamma voltages corresponding to a plurality of channels, by using the regulating voltage, and supply the gamma voltages to one or more selected channels, wherein the digital-to-analog converter comprises the current control element comprising a MOS transistor, and wherein the current control element is configured to regulate the internal voltage supplied from the internal voltage generator in response to an output current, and output the regulating voltage, wherein the digital-to-analog converter further comprises:

a comparison circuit configured to compare a reference voltage and a feedback voltage, and supply the output current corresponding to a result of the comparison to the current control element; and a sensing circuit configured to sense the regulating voltage outputted from the current control element, and supply the feedback voltage corresponding to a result of the sensing to the comparison circuit.

2. The gamma voltage supply circuit of claim 1, wherein the gamma voltages are supplied to drive data of a source driver integrated circuit.

3. The gamma voltage supply circuit of claim 1, wherein the internal voltage generator and the digital-to-analog converter are integrated in a power management integrated circuit.

4. The gamma voltage supply circuit of claim 1, wherein the internal voltage is generated using a gate voltage which is generated to be supplied to a gate driver integrated circuit.

5. The gamma voltage supply circuit of claim 4, wherein the gate voltage comprises a gate high voltage for generating gate driving signals to be outputted to gate lines of pixels in the gate driver integrated circuit.

6. The gamma voltage supply circuit of claim 1, wherein the digital-to-analog converter further comprises:

a resistor string configured to generate the gamma voltages corresponding to the plurality of channels, by using the regulating voltage; and a switch circuit including a plurality of switches which respectively transfer the gamma voltages to the plurality of channels, and configured to supply the gamma voltages to one or more selected channels according to programming states of the switches.

7. The gamma voltage supply circuit of claim 1, wherein the regulator regulates the regulating voltage to a level of the external voltage.

8. The gamma voltage supply circuit of claim 1, wherein the comparison circuit comprises:

a comparator configured to compare the reference voltage and the feedback voltage and output a signal corresponding to the comparison result;

a compensation capacitor configured to compensate for an output of the comparator; and a current control circuit configured to control the current to be supplied to the current control element, in response to the output of the comparator.

9. The gamma voltage supply circuit of claim 8, wherein the current control circuit comprises:

a first switching element configured to be controlled in its switching state in response to the output of the comparator; and a second switching element configured to be controlled in current flow therethrough by a switching state of the first switching element, wherein the second switching element is coupled with the current control element such that amounts of current flowing through them are proportional to each other.

10. The gamma voltage supply circuit of claim 9, wherein the current control element and the second switching element are transistors, and a gate of the current control element and a gate of the second switching element are coupled to each other.

11. A power management integrated circuit for supplying gamma voltages outputted from a plurality of channels, to a source driver integrated circuit, the power management integrated circuit comprising:

an internal voltage generator configured to generate an internal voltage which is boosted, by using an external voltage, and supply the internal voltage to a current control element;

a regulator configured to generate a regulating voltage by regulating the internal voltage through the current control element;

a resistor string configured to generate the gamma voltages corresponding to the plurality of channels, by using the regulating voltage;

a switch circuit including a plurality of switches which respectively transfer the gamma voltages to the plurality of channels, and configured to supply the gamma voltages to one or more selected channels according to programming states of the switches; and gamma buffers configured to output one or more gamma voltages supplied from the switch circuit, through the corresponding channels, wherein the regulator comprises the current control element comprising a MOS transistor, and wherein the current control element is configured to regulate the internal voltage supplied from the internal voltage generator in response to an output current, and output the regulating voltage, wherein the regulator further comprises:

a comparison circuit configured to compare a reference voltage and a feedback voltage, and supply the output current corresponding to a result of the comparison to the current control element; and a sensing circuit configured to sense the regulating voltage outputted from the current control element, and supply the feedback voltage corresponding to a result of the sensing to the comparison circuit.

12. The power management integrated circuit of claim 11, wherein the internal voltage comprises a gate high voltage for generating gate driving signals to be outputted to gate lines of pixels in a gate driver integrated circuit.

13. The power management integrated circuit of claim 11, wherein the regulator regulates the regulating voltage to a level of the external voltage.

* * * * *